US010149359B2

(12) United States Patent
Mori et al.

(10) Patent No.: US 10,149,359 B2
(45) Date of Patent: Dec. 4, 2018

(54) DIMMING CONTROL DEVICE, LIGHTING APPARATUS, LIGHTING SYSTEM, AND DIMMING CONTROL METHOD

(71) Applicant: Panasonic Intellectual Property Management Co., Ltd., Osaka (JP)

(72) Inventors: Yukio Mori, Osaka (JP); Shinichi Murakami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/839,940

(22) Filed: Dec. 13, 2017

(65) Prior Publication Data

US 2018/0177012 A1 Jun. 21, 2018

(30) Foreign Application Priority Data

Dec. 21, 2016 (JP) ..... 2016-247899

(51) Int. Cl.
*H05B 37/02* (2006.01)
*H05B 33/08* (2006.01)

(52) U.S. Cl.
CPC ..... *H05B 33/0845* (2013.01); *H05B 33/0809* (2013.01); *H05B 37/0254* (2013.01); *H05B 37/0281* (2013.01)

(58) Field of Classification Search
CPC ..... H05B 33/0815; H05B 33/0818; H05B 41/2828; H05B 41/3921; H05B 41/3927; H05B 37/029; H05B 33/0803; H05B 37/0254; H05B 37/02; H05B 41/28
See application file for complete search history.

(56) References Cited

U.S. PATENT DOCUMENTS

| | | | | |
|---|---|---|---|---|
| 8,699,887 | B1 * | 4/2014 | Rothenberg | H04B 10/116 315/158 |
| 2013/0211608 | A1 * | 8/2013 | Farrell | G06F 1/26 700/286 |
| 2015/0281905 | A1 * | 10/2015 | Breuer | H04B 10/116 398/118 |

FOREIGN PATENT DOCUMENTS

| | | |
|---|---|---|
| JP | S61-208794 | 9/1986 |
| JP | S64-3994 | 1/1989 |
| JP | H01-186593 | 7/1989 |
| JP | H1-186594 | 7/1989 |
| JP | 2012-146575 | 8/2012 |

* cited by examiner

*Primary Examiner* — Minh D A
(74) *Attorney, Agent, or Firm* — Renner, Otto, Boisselle & Sklar, LLP

(57) ABSTRACT

A dimming control device configured to receive dimming input level data updated at intervals, and to control a dimming level of a light source based on the dimming input level data, includes: a memory that stores the dimming input level data received prior to the newest dimming input level data; and a generator that generates dimming output level data as data having higher resolution than the dimming input level data, the dimming output level data being generated as a function of the dimming input level data received and stored in the memory.

20 Claims, 14 Drawing Sheets

DIMMING CONTROL DEVICE, LIGHTING APPARATUS, LIGHTING SYSTEM, AND DIMMING CONTROL METHOD

CROSS REFERENCE TO RELATED APPLICATION

This application claims the benefit of priority of Japanese Patent Application Number 2016-247899 filed on Dec. 21, 2016, the entire content of which is hereby incorporated by reference.

BACKGROUND

1. Technical Field

The present disclosure relates to a dimming control device, a lighting apparatus, a lighting system, and a dimming control method which control a dimming level of a light source based on a dimming input signal.

2. Description of the Related Art

Conventionally, standards such as DMX512 (a United States Institute for Theatre Technology standard) are utilized in dimming control of lighting apparatuses used for theatrical effects, etc. By using DMX512, a plurality of digital signals for controlling the dimming levels of a plurality of lighting apparatuses can be transmitted using a single DMX cable (see, for example, Japanese Unexamined Patent Application Publication No. 2012-146575).

SUMMARY

In DMX512, a dimming signal indicating the dimming level at each timing can be transmitted to a lighting apparatus. However, in DMX512, time information for fading (i.e., the operation of gradually changing the dimming level) is not included in the dimming signal. Specifically, when changing from one dimming level to another dimming level, the dimming level can be changed instantaneously but cannot be changed continuously over a predetermined time. Therefore, when causing the lighting apparatus to fade using DMX512, the dimming level of the lighting apparatus cannot be controlled more precisely than the dimming level resolution of the dimming signal. The dimming level resolution in DMX512 is 8 bits, and thus the dimming level cannot be changed more smoothly than this resolution. Particularly, in recent years, light emitting diodes (LEDs) which have high input current change-to-dimming level change response speed are being used as light sources of lighting apparatuses, and thus discontinuity of dimming level change in fading has become conspicuous.

In view of this, the present disclosure provides a dimming control device, a lighting apparatus, a lighting system, and a dimming control method capable of continuously changing the dimming level of a light source.

A dimming control device according to an aspect of the present disclosure is a dimming control device configured to receive dimming input level data updated at intervals, and to control a dimming level of a light source based on the dimming input level data, the dimming control device including: a memory that stores the dimming input level data received prior to a newest one of the dimming input level data; and a generator that generates dimming output level data as data having higher resolution than the dimming input level data, the dimming output level data being generated as a function of the dimming input level data received and stored in the memory.

Furthermore, a lighting apparatus according to an aspect of the present disclosure is a lighting apparatus, including: the dimming control device described above; a conversion circuit that outputs current according to the dimming output level data generated by the dimming control device; and a light source to which the current outputted from the conversion circuit is inputted.

Furthermore, a lighting system according to an aspect of the present disclosure is a lighting system, including: the lighting apparatus described above; and a dimmer that provides the dimming input level data to the dimming control device.

According to the present disclosure, it is possible to provide a dimming control device, a lighting apparatus, a lighting system, and a dimming control method capable of continuously changing the dimming level of a light source.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, exemplary embodiments of the present disclosure will be described in detail with reference to the drawings. It should be noted that each of the subsequently-described exemplary embodiments shows a specific example of the present disclosure. Therefore, numerical values, shapes, materials, structural components, the arrangement and connection of the structural components, etc. shown in the following exemplary embodiments are mere examples, and are not intended to limit the scope of the present disclosure. Therefore, among the structural components in the following exemplary embodiments, components not recited in any one of the independent claims which indicate the broadest concepts of the present disclosure are described as arbitrary structural components.

Furthermore, the respective figures are schematic diagrams and are not necessarily precise illustrations. In addition, in the respective diagrams, identical structural components are given the same reference signs.

Embodiment 1

A dimming control device and a lighting apparatus and lighting system which include the dimming control device according to Embodiment 1 will be described.

[1-1. Configuration]

First, a configuration of the lighting system including the dimming control device according to this embodiment will be described with reference to the drawings.

Figure 1:
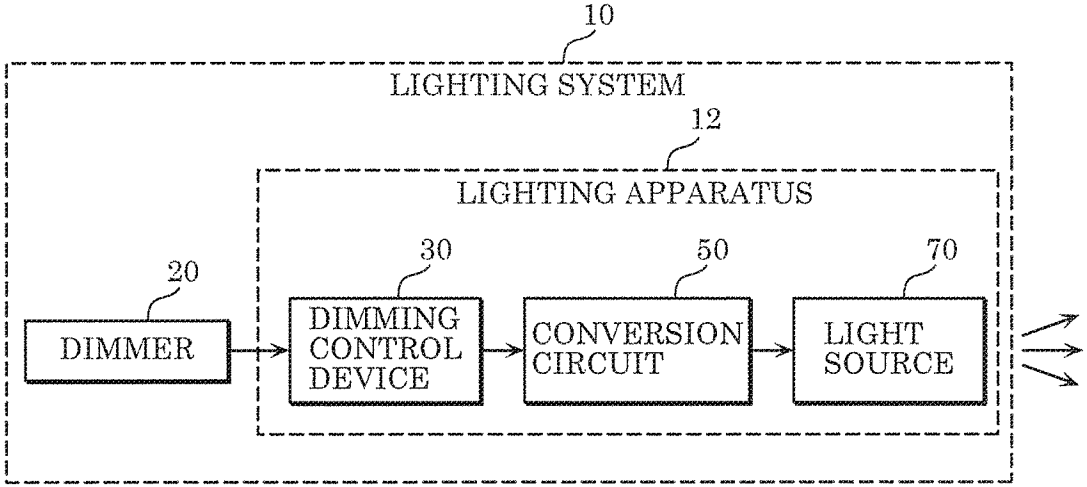
FIG. 1 is a block diagram illustrating an example of a functional configuration of a lighting system including a dimming control device according to Embodiment 1.

FIG. 1 is a block diagram illustrating an example of a functional configuration of lighting system 10 including dimming control device 30 according to this embodiment.

Lighting system 10 is a system that controls the dimming level of illumination light. As illustrated in FIG. 1, lighting system 10 includes dimmer 20 and lighting apparatus 12.

Dimmer 20 is a device that adjusts the dimming level of illumination light emitted from light source 70 of lighting apparatus 12. Dimmer 20 successively outputs dimming input signals including dimming input level data to dimming control device 30 at a predetermined updating interval, based on operation by a user, for example. The dimming input signal is a digital signal based on a certain standard and includes dimming input level data expressed in a predetermined resolution. The dimming input signal is, for example, a digital signal based on DMX512, and includes dimming input level data expressed in 8-bit resolution. The dimming input level data is a target value for the dimming level of light source 70 on which dimming control is performed. It should be noted that dimmer 20 may be a dimming operation console capable of individually controlling a plurality of light sources.

Lighting apparatus 12 is an apparatus that emits light, the dimming level of which can be controlled. The dimming level of the light emitted by lighting apparatus 12 is controlled based on a dimming input signal inputted from dimmer 20. As illustrated in FIG. 1, lighting apparatus 12 includes dimming control device 30, conversion circuit 50, and light source 70.

Dimming control device 30 is a device that successively receives dimming input level data provided at a predetermined updating interval, and controls the dimming level of light source 70 based on the dimming input level data. Dimming control device 30 is realized using a microcomputer, for example. The microcomputer is a single-chip semiconductor integrated circuit having a ROM and a RAM in which a program is stored, a processor (CPU) that executes the program, a timer, and input-output circuits including an A/D converter and a D/A converter, etc. Hereinafter, dimming control device 30 will be described in detail with reference to the drawings.

Figure 2:
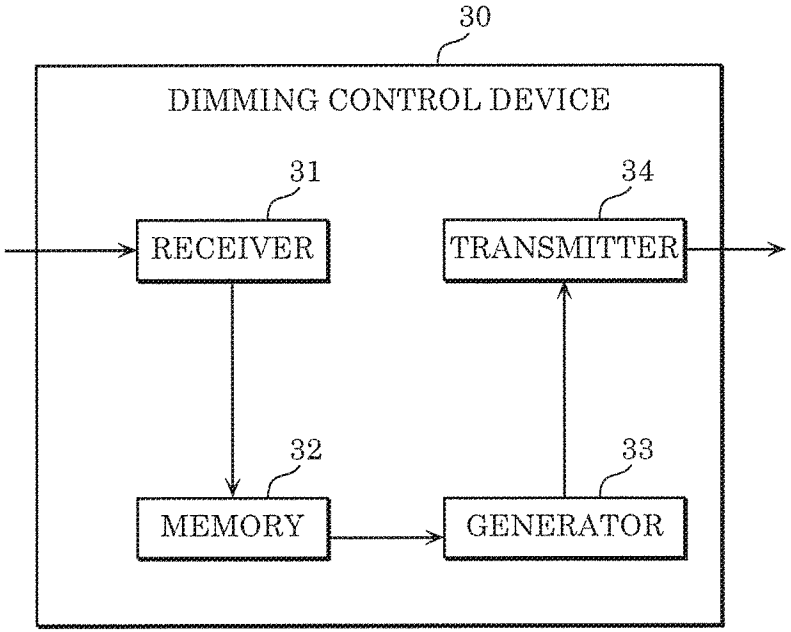
FIG. 2 is a block diagram illustrating a functional configuration of a dimming control device according to Embodiment 1.

FIG. 2 is a block diagram illustrating a functional configuration of dimming control device 30 according to this embodiment.

As illustrated in FIG. 2, dimming control device 30 includes receiver 31, memory 32, generator 33, and transmitter 34.

Receiver 31 successively receives dimming input level data successively provided from dimmer 20, and transmits the received dimming input level data to memory 32. In this embodiment, receiver 31 performs, at a predetermined sampling interval, sampling of the dimming input signals which are successively transmitted from dimmer 20 at a predetermined updating interval. The sampling interval is not particularly limited as long as it is greater than or equal to the dimming input signal updating interval. In this embodiment, sampling is performed using the updating interval for dimming output level data generated by generator 33. Each dimming input signal includes dimming input level data which is a target value of the control by dimming control device 30. Furthermore, receiver 31 may transmit the dimming input signal itself to memory 32, without performing the above-described sampling.

Memory 32 stores the dimming input level data successively received by dimming control device 30 from dimmer 20 during at least a first period extending back from the receipt of the newest dimming input level data. More specifically, memory 32 receives dimming input level data transmitted from receiver 31, and stores the dimming input level data. Memory 32, for example, stores not only the dimming input level data indicated by the newest dimming input signal but also dimming input level data indicated by older dimming input signals. Memory 32 stores at least the dimming input level data received during the first period extending back from the receipt of the newest dimming input level data. The number of dimming input level data that memory 32 stores is not particularly limited and is, for example, at least 10 and at most 200. Furthermore, the number of dimming input level data that memory 32 stores may be variable according to the operation of dimming control device 30 or the operation by a user.

Generator 33 generates dimming output level data using a plurality of the dimming input level data received and stored in memory 32 during the first period. In this embodiment, generator 33 generates, as data with a higher resolution than the dimming input level data, dimming output level data generated by averaging a plurality of dimming input level data out of the dimming input level data received and stored in memory 32 during the first period. In other words, the dimming output level data is an average of a plurality of dimming input level data stored in memory 32. More specifically, the dimming output level data is the average of all the dimming input level data received and stored in memory 32 during the first period. In this case, the dimming output level data is equivalent to the moving average of the dimming input level data. The length of the first period may be set as necessary according to the resolution of the dimming input level data included in the dimming input signal, the updating interval, the intended use of the lighting apparatus, etc. The length of the first period is, for example, approximately at least 23 times to at most 210 times the updating interval of a dimming output signal.

Transmitter 34 transmits a dimming output signal including the dimming output level data generated by generator 33 to conversion circuit 50. Transmitter 34 successively transmits dimming output signals at an updating interval shorter than the updating interval of the dimming input signal.

Conversion circuit 50 is a device that converts the dimming output signals successively received from dimming control device 30 into power corresponding to the dimming output signals, and supplies the power to light source 70. Conversion circuit 50 is, for example, a power supply circuit that converts alternating current power supplied from a system power supply, such as a commercial alternating current power supply, into direct current power corresponding to the dimming output signals, and outputs the direct current power. Specifically, conversion circuit 50 may be, for example, a combination of a rectifier circuit and a DC/DC converter. In this case, the dimming output signals are transmitted to the control circuit of the DC/DC converter. Then, in the control circuit, the power to be supplied to light source 70 may be controlled by setting the duty ratio of a switching element for chopping in the DC/DC converter to a value corresponding to the dimming output level data. In this embodiment, conversion circuit 50 controls the size of the current to be supplied to light source 70.

Light source 70 is an element that emits illumination light under supply of power. The configuration of light source 70 is not particularly limited. In this embodiment, light source 70 is an LED and is supplied with direct current from conversion circuit 50. The dimming level of light source 70 is controlled by adjusting the amount of current supplied.

[1-2. Operation]

The operation of dimming control device 30 as well as lighting apparatus 12 and lighting system 10 which include dimming control device 30, according to this embodiment, will be described.

Here, in order to simplify the description of the operation of dimming control device 30 according to this embodiment, it is assumed that the dimming input level data resolution is 10 and the dimming output level data resolution is 100. Furthermore, the dimming output signal updating interval is assumed to be 0.25 times the dimming input signal updating interval. In other words, the dimming output signal updating interval standardized according to the dimming input signal updating interval is assumed to be 0.25. Furthermore, the first period used in generator 33 is set at 10 times the dimming output signal updating interval (i.e., 2.5 times the dimming input signal updating interval).

Here, the dimming input signals in the case where fading is performed in lighting system 10 will be described with reference to the drawings.

Figure 3:
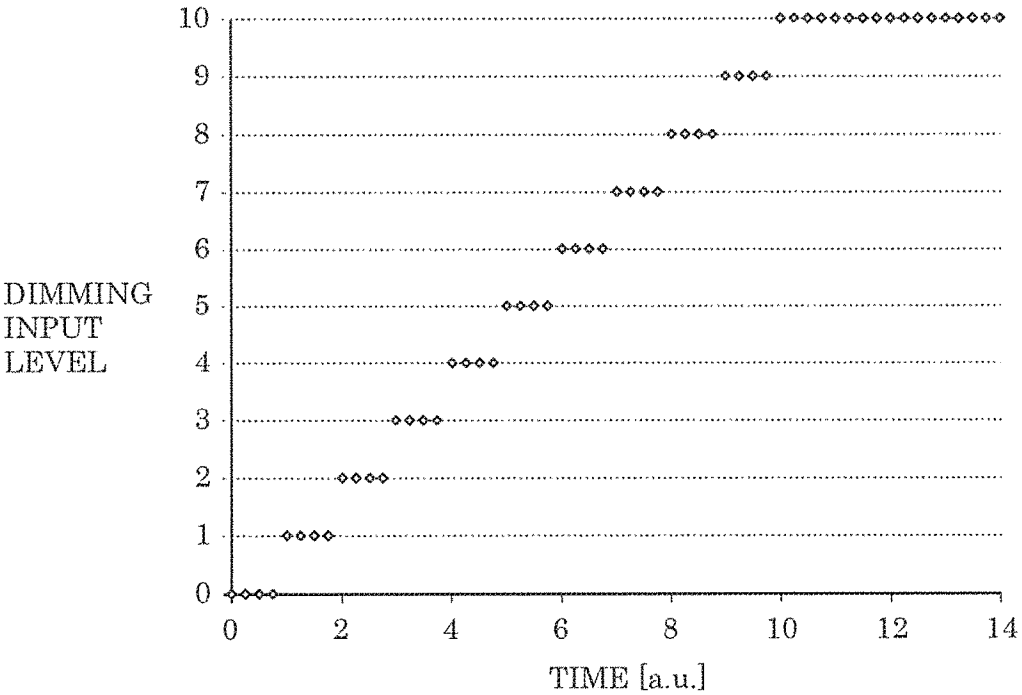
FIG. 3 is a graph illustrating an example of a relationship between dimming input level data and time according to Embodiment 1.
Figure 4:
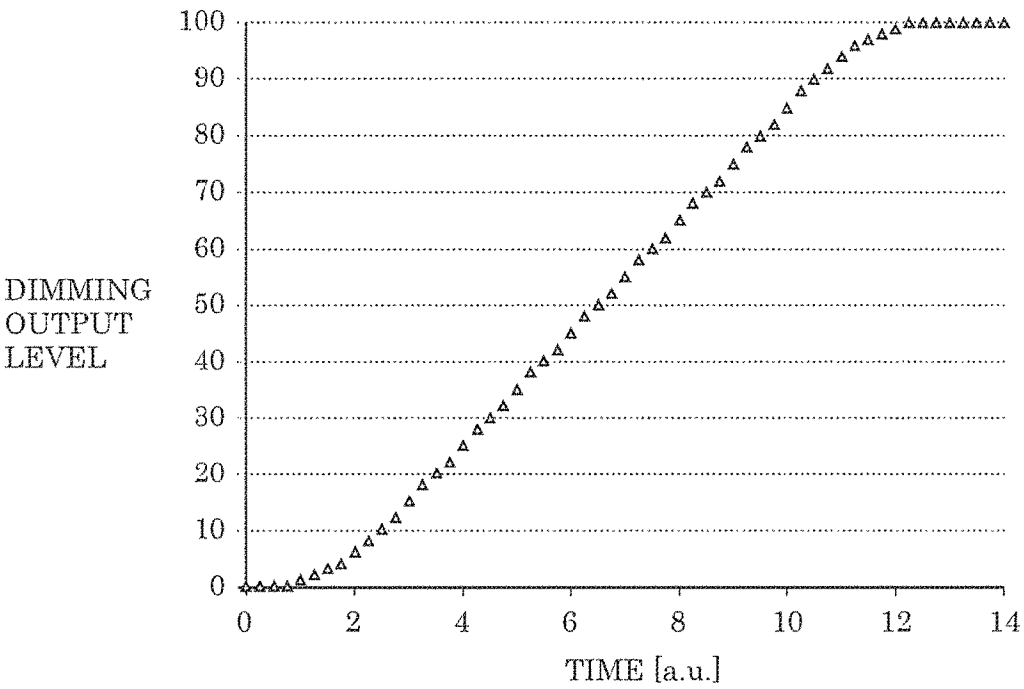
FIG. 4 is a graph illustrating an example of a relationship between dimming output level data and time according to Embodiment 1.
Figure 5:
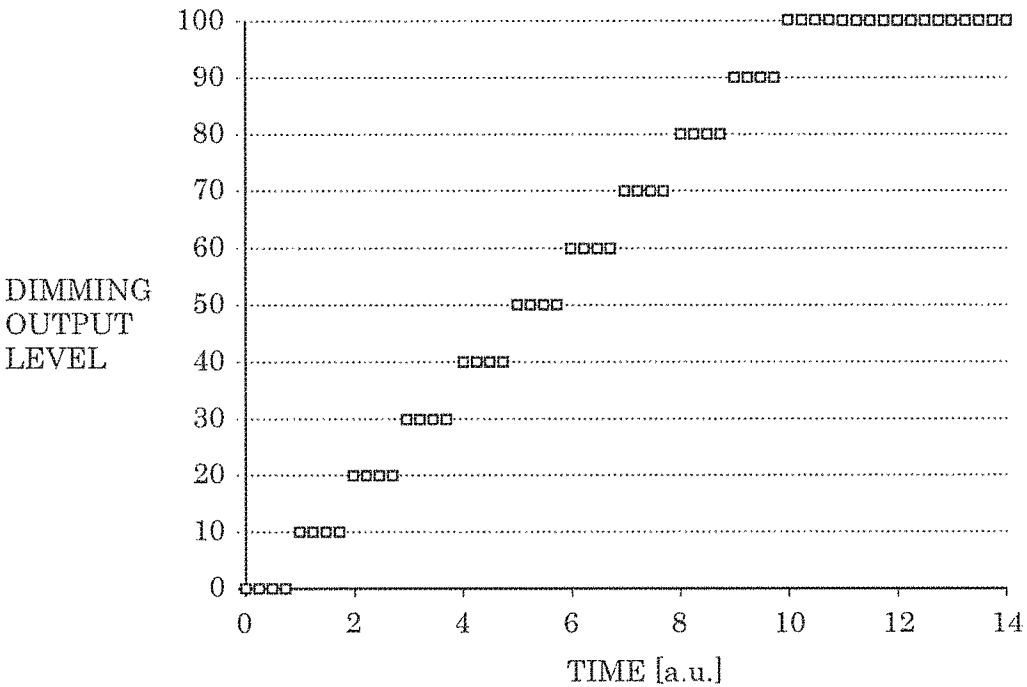
FIG. 5 is a graph illustrating an example of a relationship between dimming output level data and time according to a comparative example.

FIG. 3 is a graph illustrating an example of the relationship between dimming input level data and time according to this embodiment. FIG. 3 illustrates a graph for the case where dimming input level data rises 1 resolution level at every dimming input signal update interval. FIG. 4 is a graph illustrating an example of the relationship between dimming output level data and time according to this embodiment. FIG. 4 illustrates dimming output level data corresponding to the dimming input level data illustrated in FIG. 3. FIG. 5 is a graph illustrating an example of the relationship between dimming output level data and time according to a comparative example. FIG. 5 illustrates, as a comparative example, a graph for the case where a value equal to the dimming input level data is used as the dimming output level data.

In the examples illustrated in FIG. 3 and FIG. 4, in dimming control device 30, dimming output level data is generated using a plurality of dimming input level data received and stored in memory 32 during the first period extending back from the receipt of the dimming input level data received last by dimming control device 30 (i.e., the newest dimming input level data), with the first period being 10 times the dimming output signal updating interval. In this operation example, the dimming output level data is the average of a plurality of dimming input level data. More specifically, the dimming output level data is the average of all the dimming input level data received and stored in memory 32 during the first period. In this case, the dimming output level data is equivalent to the moving average of the dimming input level data. In addition, the dimming output level data has a higher resolution than the dimming input level data. Accordingly, in a case where the dimming input level data changes in steps as illustrated in FIG. 3, the amount of change in the dimming output level data is reduced compared to the amount of change in the dimming input level data. Therefore, as illustrated in FIG. 4, the dimming output level data can be changed continuously with respect to time. By performing dimming control of light source 70 using dimming output signals including dimming output level data obtained in this manner, the dimming level of light source 70 can be changed continuously.

Furthermore, in this embodiment, the updating interval of the dimming output level data is shorter than the updating interval of the dimming input level data. Accordingly, since the amount of change at the time of updating dimming output level data can be further reduced, the dimming output level data can be changed more continuously with respect to time.

In contrast, in the case where a value equal to the dimming input level data is used as the dimming output level data as illustrated in FIG. 5, even when the resolution of the dimming output level data is higher than the resolution of the dimming input level data, and the updating interval of the dimming output level data is shorter than the updating interval of the dimming input level data, the dimming output level data changes in steps in the same manner as the dimming input level data. In this manner, in the comparative example, the dimming output level data cannot be changed continuously with respect to time.

It should be noted that although, in the operation example described above, generator 33 generates dimming output level data equivalent to a moving average of the dimming input level data, the configuration of generator 33 is not limited to such. It is sufficient that generator 33 generates dimming output level data with higher resolution than dimming input level data by using a plurality of the dimming input level data received and stored in memory 32 during the first period. Accordingly, the amount of change at the time of updating the dimming output level data can be reduced compared to the amount of change at the time of updating of the dimming input level data. Therefore, the dimming output level data can be changed continuously with respect to time. Furthermore, in generator 33, all of the dimming input level data received and stored in memory 32 during the first period need not be used as the dimming input level data to be used in generating the dimming output level data. For example, it is sufficient to use at least two out of the sampled dimming input level data. Even in the case of using at least two dimming input level data as described above, by using the average of the two dimming input level data, for example, as the dimming output level data, the amount of change per dimming output level data updating interval can be reduced to at most half the amount of change in the dimming input level data. Therefore, the dimming output level data can be changed more continuously with respect to time.

[1-3. Conclusion]

As described above, dimming control device 30 according to this embodiment is a device configured to successively receive dimming input level data provided at a predetermined updating interval, and to control the dimming level of the light source based on the dimming input level data. Dimming control device 30 includes memory 32 that stores the dimming input level data received successively during a first period extending back from receipt of a newest one of the dimming input level data, and generator 33 that generates dimming output level data as data having higher resolution than the dimming input level data, by averaging a plurality of dimming input level data out of the dimming input level data received and stored in the memory during the first period.

Accordingly, the amount of change per updating interval of the dimming output level data can be reduced compared to the amount of change of dimming input level data. Therefore, the dimming output level data can be changed more continuously with respect to time. In other words, in fading, the dimming level of light source 70 can be changed smoothly.

Furthermore, dimming control device 30 according to this embodiment is a device configured to receive dimming input level data updated at intervals, and to control a dimming level of a light source based on the dimming input level data. Dimming control device 30 includes memory 32 that stores the dimming input level data received prior to a newest one of the dimming input level data, and generator 33 that generates dimming output level data as data having higher resolution than the dimming input level data, the dimming output level data being generated as a function of the dimming input level data received and stored in memory 33.

Furthermore, in dimming control device 30, generator 33 may generate the dimming output level data as an average of all the dimming input level data received and stored in the memory during the first period.

Furthermore, in dimming control device 30, generator 33 may generate, as data with a higher resolution than the dimming input level data, dimming output level data generated by averaging a plurality of dimming input level data out of the dimming input level data received and stored in memory 32 during the first period.

Accordingly, the amount of change per updating interval of the dimming output level data can be reliably reduced compared to the amount of change of dimming input level data.

Furthermore, in dimming control device 30, the dimming output level data may be the average of all the dimming input level data received and stored in memory 32 during the first period.

Accordingly, the amount of change per updating interval of the dimming output level data can be more reliably reduced compared to the amount of change of dimming input level data.

Furthermore, in dimming control device 30, the dimming output level data may have a shorter updating interval than the dimming input level data.

Accordingly, the amount of change per updating interval of the dimming output level data can be reduced compared to the amount of change of dimming input level data.

Furthermore, lighting apparatus 12 according to this embodiment includes dimming control device 30, conversion circuit 50 which output current according to dimming output level data generated by dimming control device 30, and light source 70 to which the current outputted from conversion circuit 50 is inputted.

Accordingly, lighting apparatus 12 produces the same advantageous effects as dimming control device 30.

Furthermore, lighting system 10 according to this embodiment includes dimming control device 30, lighting apparatus 12, and dimmer 20.

Accordingly, lighting system 10 produces the same advantageous effects as dimming control device 30.

Embodiment 2

A dimming control device according to Embodiment 2 will be described. The dimming control device according to this embodiment has a configuration capable of improving responsiveness in the case of suddenly changing the dimming level. The dimming control device according to this embodiment is different from dimming control device 30 according to Embodiment 1 in the method of generating dimming output level data in the generator. Hereinafter, the dimming control device according to this embodiment will be described with reference to the drawings, focusing on the differences from dimming control device 30 according to Embodiment 1.

[2-1. Configuration]

Figure 6:
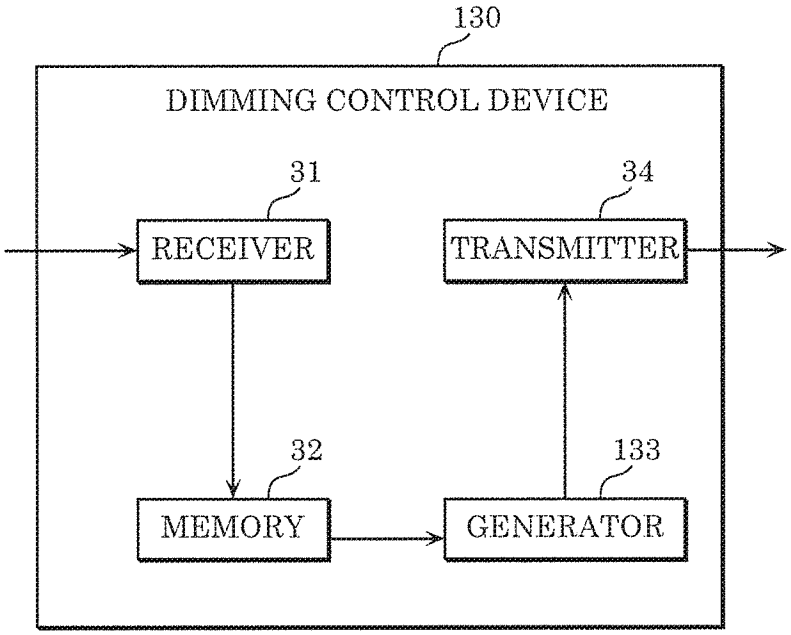
FIG. 6 is a block diagram illustrating a functional configuration of a dimming control device according to Embodiment 2.

FIG. 6 is a block diagram illustrating a functional configuration of dimming control device 130 according to this embodiment.

As illustrated in FIG. 6, dimming control device 130 includes receiver 31, memory 32, generator 133, and transmitter 34, in the same manner as dimming control device 30 according to Embodiment 1.

Generator 133 generates dimming output level data in the same manner as generator 33 in Embodiment 1 when the difference between first dimming input level data and second dimming input level data received before the first dimming input level data, out of the dimming input level data received during a second period which extends back from the receipt of the newest dimming input level data and is shorter than the first period, is smaller than a threshold. On the other hand, when the difference between the first dimming input level data and the second dimming input level data is bigger than the threshold, the first dimming input level data is used as the dimming output level data.

The second period is not particularly limited as long as it is shorter than the first period and longer than or equal to the updating interval of the dimming input level data. However, the responsiveness of dimming control device 130 to dimming input signals improves as the second period is shorter.

In this embodiment, when the difference between the newest received (or sampled) dimming input level data and the dimming input level data received (or sampled) immediately before is bigger than the threshold, the newest received dimming input level data is used as the dimming output level data. When the difference is smaller than the threshold, generator 133 generates dimming output level data in the same manner as generator 33 according to Embodiment 1.

The threshold used in generator 133 can be set to a certain value bigger than the resolution of the dimming input level data, according to the characteristics of light source 70 which is the dimming target, the intended use of the lighting apparatus and the lighting system, etc. The threshold may be a value that is 80% the full scale of the dimming level.

Here, the procedure for the generation of dimming output level data by generator 133 will be described with reference to the drawings.

Figure 7:
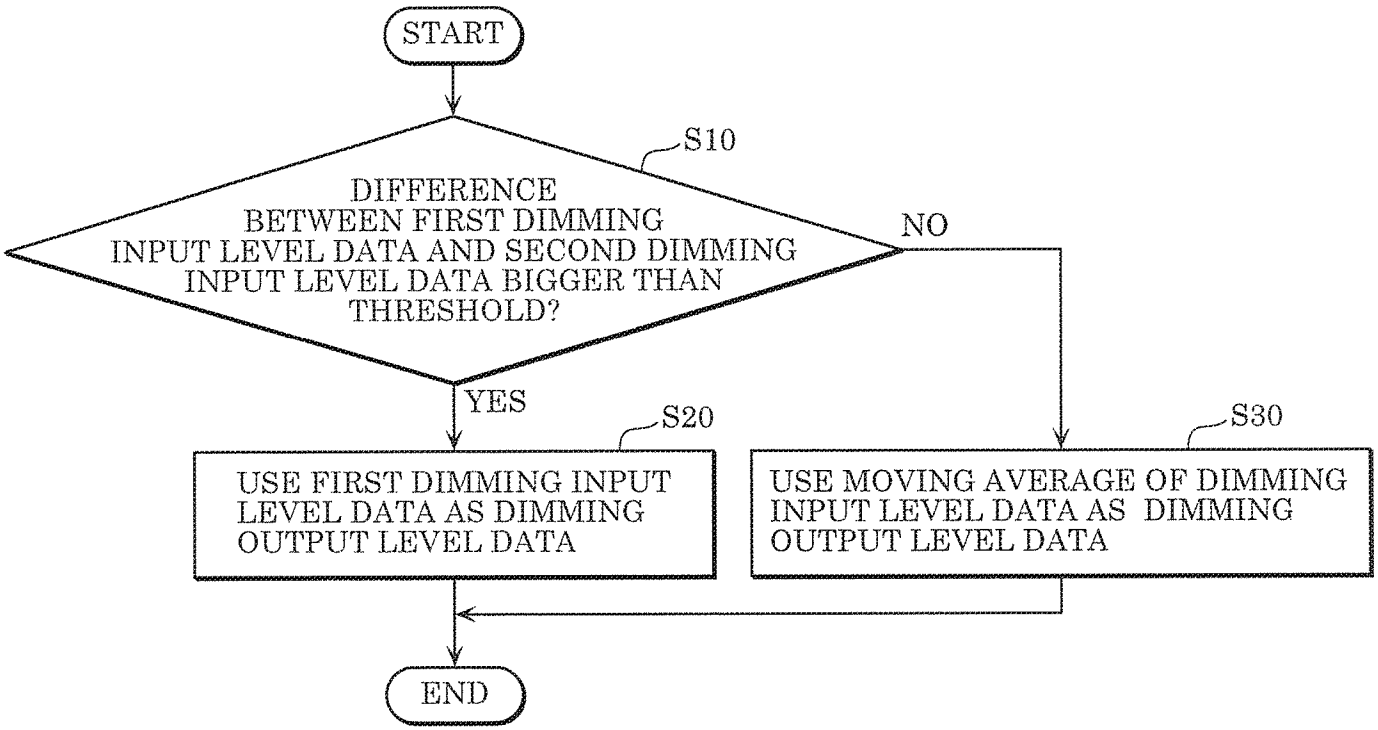
FIG. 7 is a flowchart illustrating a method of generating dimming output level data executed by a generator according to Embodiment 2.

FIG. 7 is a flowchart illustrating a method of generating dimming output level data executed by generator 133 according to this embodiment.

As illustrated in FIG. 7, generator 133 first determines whether the difference between the first dimming input level data and the second dimming input level data received before the first dimming output level data is bigger than the threshold (S10).

Here, when the difference is bigger than the threshold (YES in S10), generator 133 uses the first dimming input level data as the dimming output level data (S20). In this embodiment, the dimming input level data that was received (or sampled) last, in other words the newest dimming input level data, is used as the first dimming input level data.

On the other hand, when the difference is smaller than or equal to the threshold (NO in S10), generator 133 uses the moving average of the dimming input level data as the dimming output level data (S30).

By way of generator 133 generating dimming output level data in the above-described manner, dimming output level data can be continuously changed during fading in the same manner as generator 33 according to Embodiment 1. On the other hand, in the case where the dimming input level data suddenly changes, the responsiveness of the dimming output level data to the dimming input level data can be improved.

[2-2. Operation]

The operation of dimming control device 130 according to this embodiment will be described with reference to the drawings.

Here, in order to simplify the description of the operation of dimming control device 130 according to this embodiment, it is assumed that the dimming input level data resolution is 10 and the dimming output level data resolution is 100, in the same manner as in the example operation used in Embodiment 1. Furthermore, the dimming output signal updating interval is assumed to be 0.25 times the dimming input signal updating interval. Furthermore, the first period used in generator 133 is set at 10 times the dimming output signal updating interval.

Figure 8:
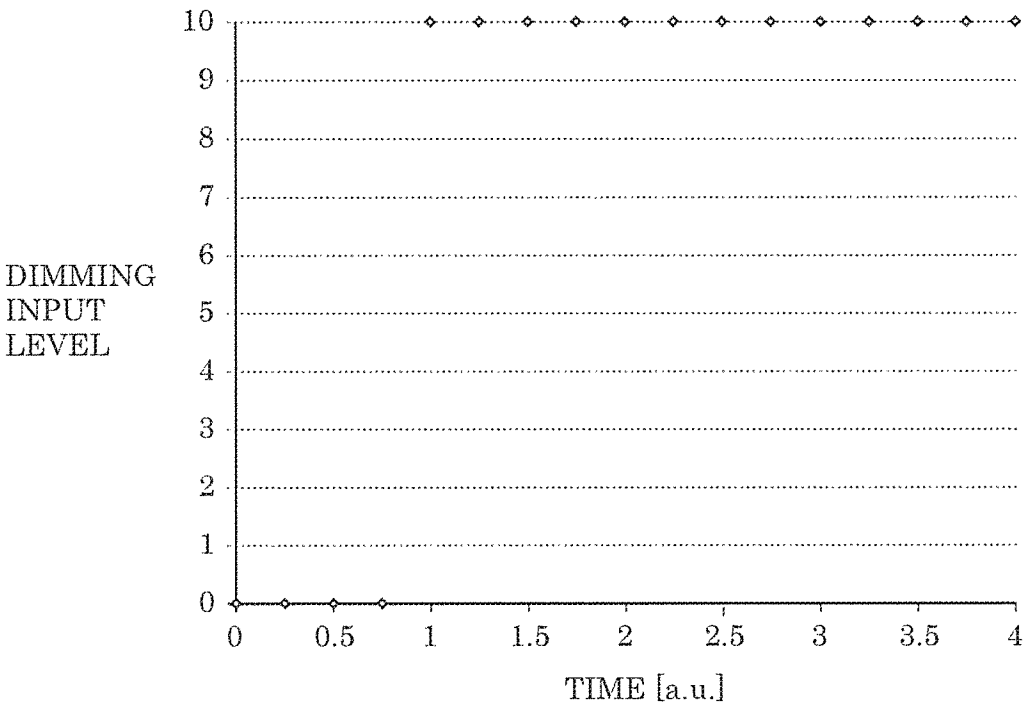
FIG. 8 is a graph illustrating an example of a relationship between dimming input level data and time according to Embodiment 2.
Figure 9:
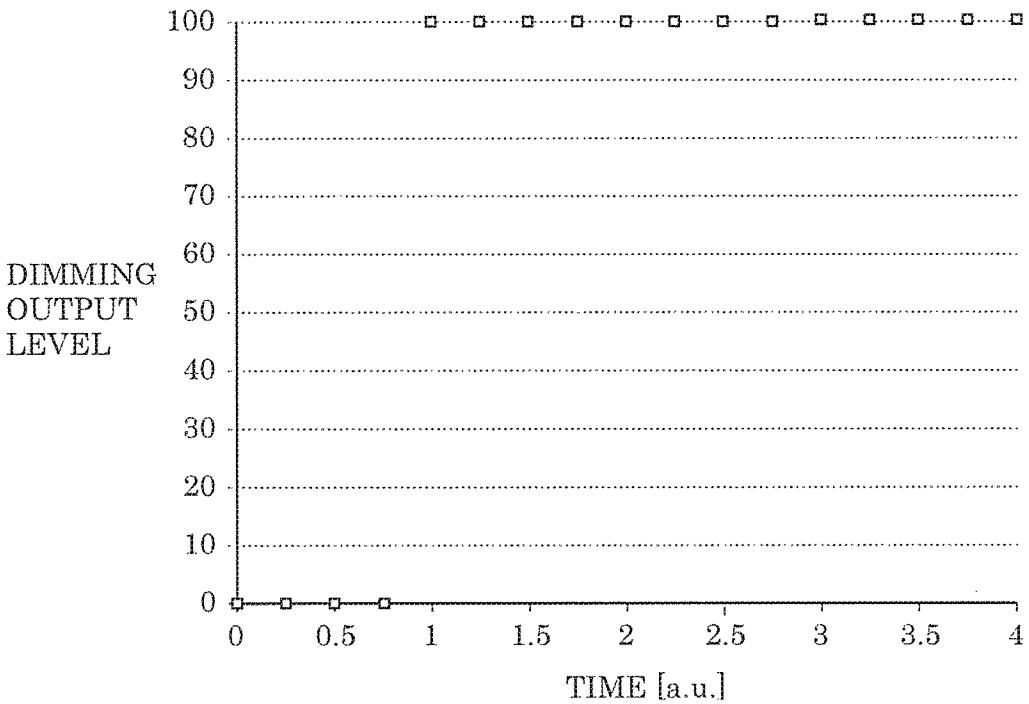
FIG. 9 is a graph illustrating an example of a relationship between dimming output level data and time according to Embodiment 2.
Figure 10:
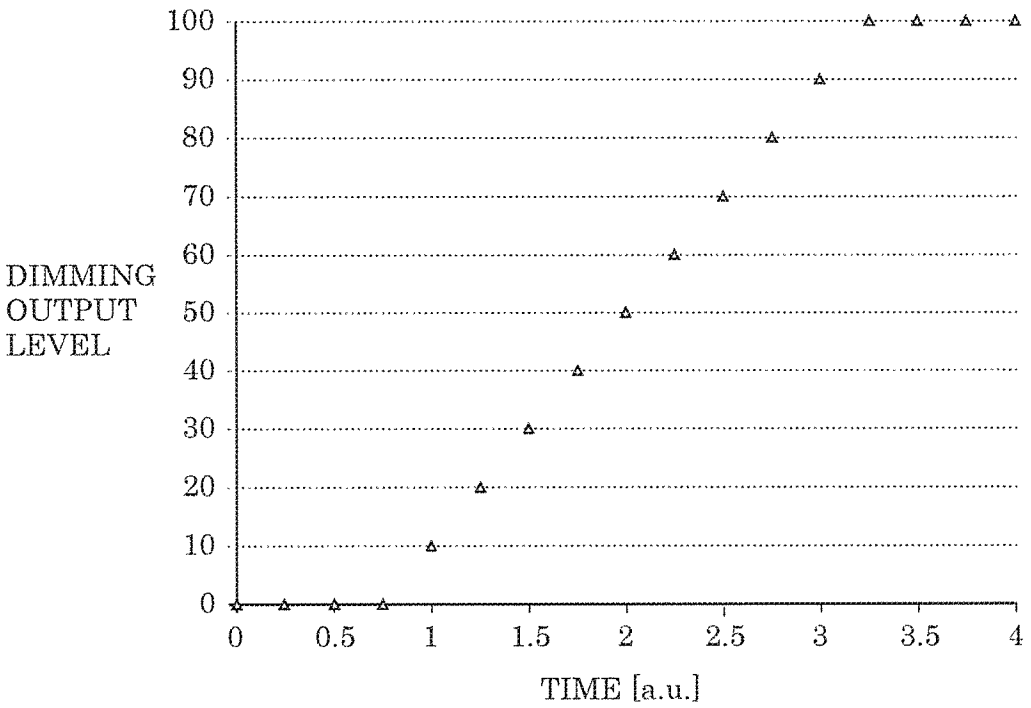
FIG. 10 is a graph illustrating an example of a relationship between dimming output level data and time according to a comparative example.

FIG. 8 is a graph illustrating an example of the relationship between dimming input level data and time according to this embodiment. FIG. 8 illustrates a graph for the case where dimming input level data suddenly changes from 0 to the maximum value 10 at the point where time is 1. FIG. 9 is a graph illustrating an example of the relationship between dimming output level data and time according to this embodiment. FIG. 9 illustrates dimming output level data corresponding to the dimming input level data illustrated in FIG. 8. FIG. 10 is a graph illustrating an example of the relationship between dimming output level data and time according to a comparative example. FIG. 10 illustrates, as a comparative example, dimming output level data generated by generator 33 according to Embodiment 1 and corresponding to the dimming input level data illustrated in FIG. 8.

As illustrated in FIG. 8, when the dimming input level data suddenly changes, the dimming output level data generated by generator 33 according to Embodiment 1 gradually rises, from the point in time where time is 1 to the point in time where time is 3, as illustrated in FIG. 10 because the dimming output level data is equal to the moving average of the dimming input level data.

On the other hand, as illustrated in FIG. 9, the dimming output level data generated by generator 133 according to this embodiment suddenly changes from 0 to 100 (maximum value) at the point in time where time is 1, in the same manner as the dimming input level data. In generator 133 according to this embodiment, as described with reference to FIG. 7, when the difference between the first dimming input level data and the second dimming input level data is bigger than the threshold (in this embodiment, 80% of full scale), the first dimming input level data is used as the dimming output level data. Accordingly, when the dimming input level data suddenly changes, generator 133 can respond rapidly to the dimming input level data.

On the other hand, with regard to fading, generator 133 can continuously change the dimming output level data in the same manner as generator 33 according to Embodiment 1.

[2-3. Conclusion]

As described above, in dimming control device 130 according to this embodiment, when the difference between the first dimming input level data and the second dimming input level data received before the first dimming input level data, out of the dimming input level data received during a second period, which extends back from the receipt of the newest dimming input level data and is shorter than the first period, is bigger than the threshold, generator 133 uses the first dimming input level data as the dimming output level data.

Accordingly, in dimming control device 130 according to this embodiment, when the dimming input level data suddenly changes, generator 133 can respond rapidly to the dimming input level data.

Embodiment 3

A dimming control device according to Embodiment 3 will be described. The dimming control device according to Embodiment 3 is different from dimming control device 30 according to Embodiment 1 in that the first period used in the generator is variable. Hereinafter, the dimming control device according to this embodiment will be described with reference to the drawings, focusing on the differences from dimming control device 30 according to Embodiment 1.

[3-1. Configuration]

Figure 11:
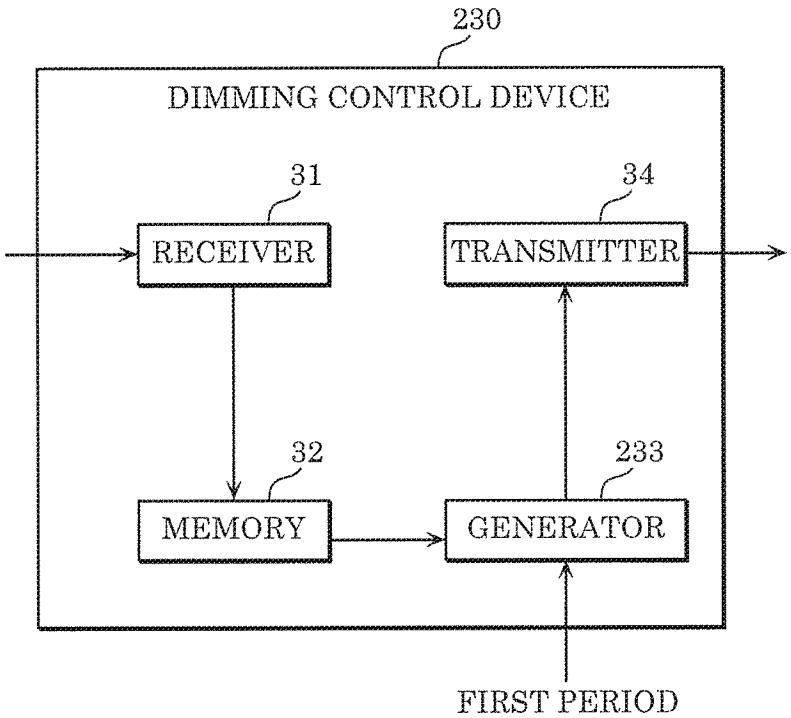
FIG. 11 is a block diagram illustrating a functional configuration of a dimming control device according to Embodiment 3.

FIG. 11 is a block diagram illustrating a functional configuration of dimming control device 230 according to this embodiment.

As illustrated in FIG. 11, dimming control device 230 according to this embodiment includes receiver 31, memory 32, generator 233, and transmitter 34 in the same manner as dimming control device 30 according to Embodiment 1.

Generator 233 generates dimming output level data using a plurality of the dimming input level data received and stored in memory 32 during the first period, in the same manner as generator 33 according to Embodiment 1. In this embodiment, the dimming output level data is the moving average of all the dimming input level data received and stored in the memory during the first period.

In this embodiment, the first period used in generator 233 is variable. The configuration for changing the first period is not particularly limited. The first period may be transmitted as a signal from an external input device, or may be made changeable by means of a dial, etc., provided in dimming control device 230. Accordingly, the first period can be changed to the optimal value according to the manner in which the dimming input level data changes during fading.

[3-2. Operation]

The operation of dimming control device 230 according to this embodiment will be described with reference to the drawings. Here, in order to simplify the description of the operation of dimming control device 230 according to this embodiment, it is assumed that the dimming input level data resolution is 10 and the dimming output level data resolution is 1000. Furthermore, the dimming output signal updating interval is assumed to be 0.25 times the dimming input signal updating interval. In other words, the dimming output signal updating interval standardized according to the dimming input signal updating interval is assumed to be 0.25.

Figure 12:
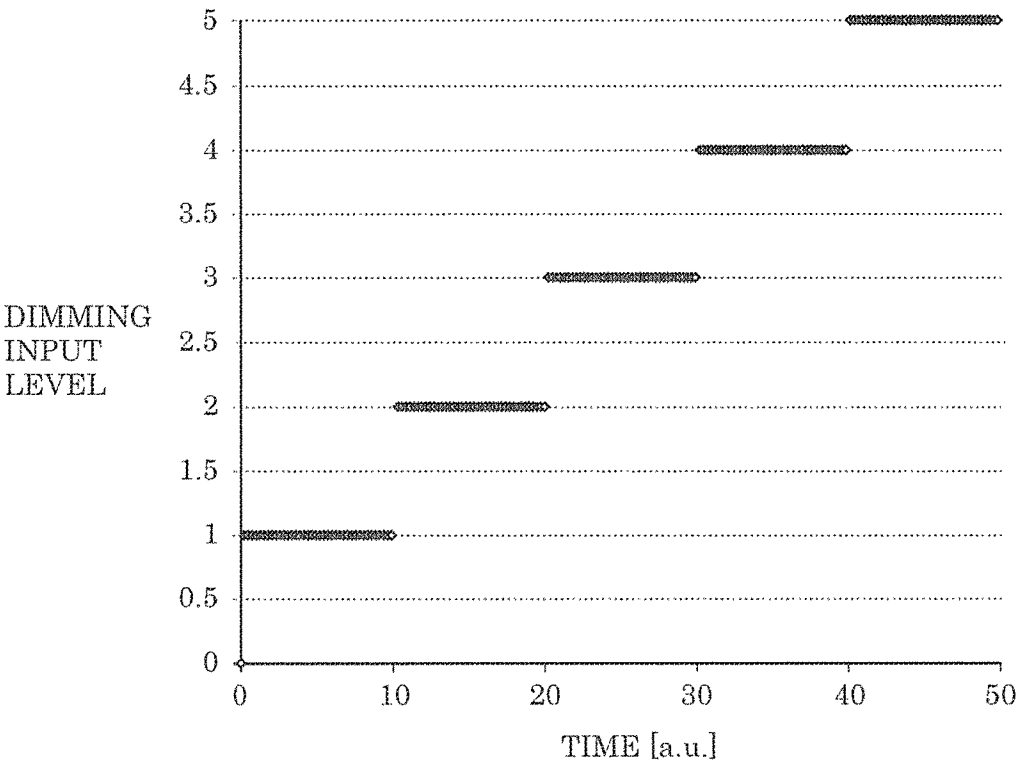
FIG. 12 is a graph illustrating an example of a relationship between dimming input level data and time according to Embodiment 3.
Figure 13:
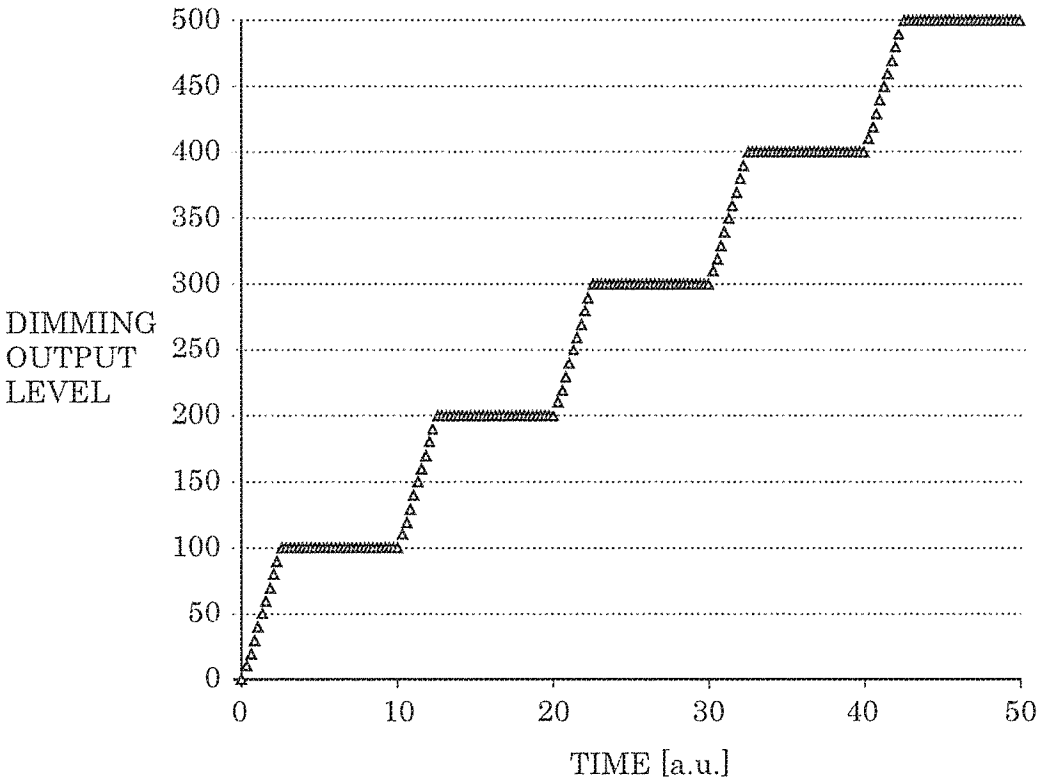
FIG. 13 is a graph illustrating an example of a relationship between dimming output level data and time according to Embodiment 3.
Figure 14:
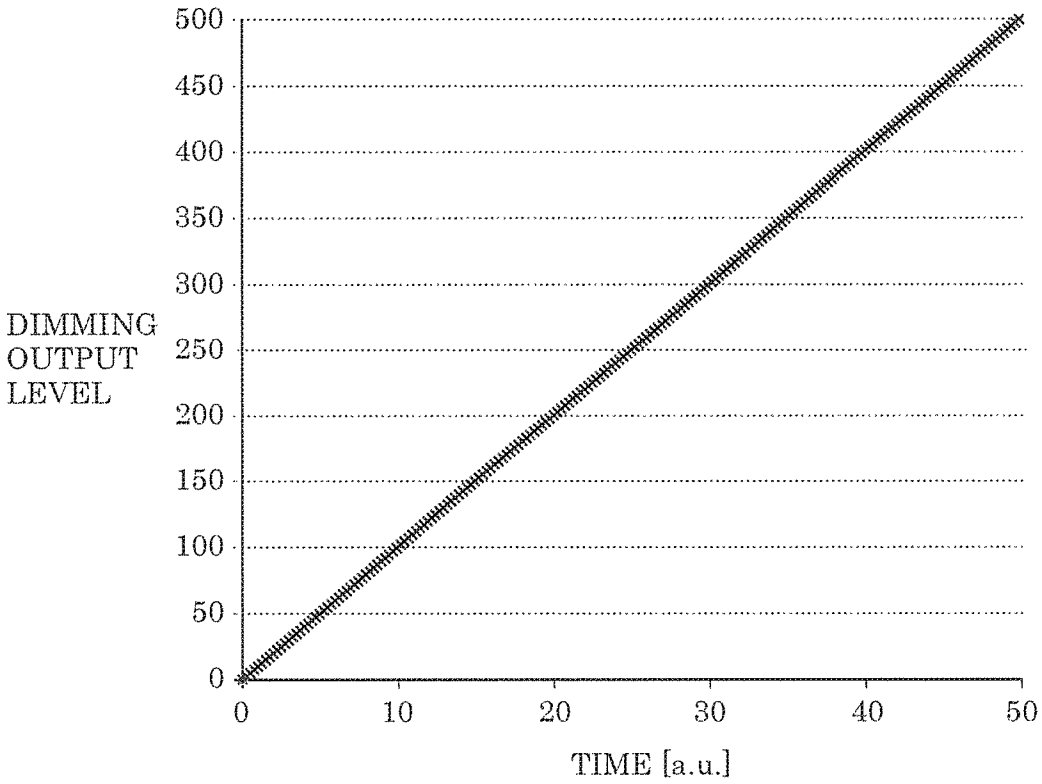
FIG. 14 is a graph illustrating another example of a relationship between dimming output level data and time according to Embodiment 3.

FIG. 12 is a graph illustrating an example of the relationship between dimming input level data and time according to this embodiment. FIG. 12 illustrates a graph of a case where the dimming level rises by 1-level increments at a time interval that is 10 times the dimming input signal updating interval. FIG. 13 is a graph illustrating an example of the relationship between dimming input level data and time according to this embodiment. FIG. 13 illustrates dimming output level data which corresponds to the dimming input level data illustrated in FIG. 12 and is dimming output level data in the case where the first period is 10 times the updating interval of the dimming output level data (i.e., 2.5 times the dimming input signal updating interval). FIG. 14 is a graph illustrating another example of the relationship between dimming output level data and time according to this embodiment. FIG. 14 illustrates dimming output level data which corresponds to the dimming input level data illustrated in FIG. 12 and is dimming output level data in the case where the first period is 40 times the updating interval of the dimming output level data (i.e., 10 times the dimming input signal updating interval).

As illustrated in FIG. 12, in dimming control device 230, in the case where fading is performed very gradually, there are cases where the dimming output level data cannot be changed continuously as illustrated in FIG. 13, even when the moving average of the dimming input level data is used as the dimming output level data. Accordingly, in such a case, changing the first period to a bigger value enables the dimming output level data to be changed continuously as illustrated in FIG. 14.

[3-3. Conclusion]

As describe above, in dimming control device 230 according this embodiment, the first period is variable.

Accordingly, the first period can be adjusted according to the manner in which the dimming input level data changes during fading. Therefore, the dimming output level data can be changed continuously regardless of the manner in which the dimming input level data changes.

(Variations, Etc.)

Although the present disclosure is described based on respective embodiments thus far, the present disclosure is not limited to the foregoing embodiments.

For example, although the difference between the first dimming input level data and the second dimming input level data is compared with a threshold in Embodiment 2, the first dimming input level data and the moving average may be compared. Furthermore, the difference between a moving average including the first dimming input level data and a moving average that does not include first dimming input level data and includes the second dimming input level data may be compared with the threshold. Furthermore, the difference between (i) the moving average including the first dimming input level data and (ii) the second dimming input level data may be compared with the threshold.

Furthermore, although each of the foregoing embodiments shows an example in which a simple average is used in calculating the average, the average calculation method is not limited to such. For example, a weighted average may be used.

Furthermore, although the foregoing embodiments show an example in which signals based on DMX512 are used as the dimming input signals transmitted from dimmer 20 to dimming control device 30, the configuration of the dimming input signal is not limited to this. For example, the dimming input signal may be a signal based on a standard such as Ethernet (registered trademark). In this case, the dimming input signal can be transmitted from a general-purpose device such as a personal computer (PC), a tablet terminal, etc. Furthermore, the dimming input signal may be a pulse width modulation (PWM) signal.

Furthermore, although dimming control device 30 is included in lighting apparatus 12 in the foregoing embodiments, dimming control device 30 may be provided independently from lighting apparatus 12.

Aside from the above, forms obtained by various modifications to the respective exemplary embodiments that can be conceived by a person of skill in the art as well as forms realized by arbitrarily combining structural components and functions in the respective exemplary embodiments which are within the scope of the essence of the present disclosure are included in the present disclosure.

For example, the functions of generator 133 according to Embodiment 2 and the functions of generator 233 according to Embodiment 3 may be combined.

What is claimed is:

1. A dimming control device configured to receive dimming input level data updated at intervals, and to control a dimming level of a light source based on the dimming input level data, the dimming control device comprising:

a memory that stores the dimming input level data received prior to a newest one of the dimming input level data; and a generator that generates dimming output level data as data having a dimming level resolution higher than a dimming level resolution of the dimming input level data, the dimming output level data being generated as a function of the dimming input level data received and stored in the memory.

2. The dimming control device according to claim 1, wherein the memory stores the dimming input level data received successively during a first period extending back from receipt of a newest one of the dimming input level data.

3. The dimming control device according to claim 2, wherein the dimming control device varies the first period.

4. The dimming control device according to claim 2, wherein when a difference between first dimming input level data and second dimming input level data received before the first dimming input level data, out of the dimming input level data received during a second period, is bigger than a threshold, the generator uses the first dimming input level data as the dimming output level data, the second period being a period which extends back from the receipt of the newest one of the dimming input level data and is shorter than the first period.

5. The dimming control device according to claim 2, wherein the first period is at least 23 times and at most 210 times as long as the updating interval of the dimming input level data.

6. The dimming control device according to claim 1, wherein the generator generates the dimming output level data by averaging a plurality of dimming input level data out of the dimming input level data stored in the memory.

7. The dimming control device according to claim 1, wherein the generator generates the dimming output level data as an average of all the dimming input level data received and stored in the memory prior to the newest one of the dimming input level data.

8. The dimming control device according to claim 1, wherein the dimming output level data has an updating interval shorter than the updating interval of the dimming input level data.

9. The dimming control device according to claim 1, wherein the generator generates the dimming output level data as a moving average of the dimming input level data.

10. The dimming control device according to claim 1, wherein the generator generates the dimming output level data as an average of all the dimming input level data stored in the memory.

11. The dimming control device according to claim 1, wherein the dimming control device varies a total number of the dimming input level data stored in the memory.

12. The dimming control device according to claim 1, wherein a total number of the dimming input level data stored in the memory is at least 10 and at most 200.

13. A lighting apparatus, comprising:

the dimming control device according to claim 1;

a conversion circuit that outputs current according to the dimming output level data generated by the dimming control device; and a light source to which the current outputted from the conversion circuit is inputted.

14. A lighting system, comprising:

the lighting apparatus according to claim 13; and a dimmer that provides the dimming input level data to the dimming control device.

15. A dimming control method of receiving dimming input level data updated at intervals, and controlling a dimming level of a light source based on the dimming input level data, the dimming control method comprising:

storing the dimming input level data received prior to a newest one of the dimming input level data; and generating dimming output level data as data having a dimming level resolution higher than a dimming level resolution of the dimming input level data, the dimming output level data being generated as a function of the dimming input level data received and stored in the storing.

16. The dimming control method according to claim 15, wherein in the storing, the dimming input level data received successively during a first period extending back from receipt of a newest one of the dimming input level data is stored.

17. The dimming control method according to claim 15, wherein in the generating, the dimming output level data is generated by averaging a plurality of dimming input level data out of the dimming input level data stored in the storing.

18. The dimming control method according to claim 16, wherein in the generating, when a difference between first dimming input level data and second dimming input level data received before the first dimming input level data, out of the dimming input level data received during a second period, is bigger than a threshold, the first dimming input level data is used as the dimming output level data, the second period being a period which extends back from the receipt of the newest one of the dimming input level data and is shorter than the first period.

19. The dimming control method according to claim 15, wherein in the generating, the dimming output level data is generated as a moving average of the dimming input level data.

20. The dimming control method according to claim 15, wherein a total number of the dimming input level data stored in the storing is variable.

* * * * *